US005456190A

United States Patent [19]

Good

[11] Patent Number: 5,456,190

[45] Date of Patent: Oct. 10, 1995

[54] STACKABLE SKID CONSTRUCTION

[76] Inventor: Bruce R. Good, 54 Tanya Ct., Plantsville, Conn. 06479

[21] Appl. No.: 221,868

[22] Filed: Apr. 1, 1994

[51] Int. Cl.[6] ..... B65D 19/38

[52] U.S. Cl. ..... 108/53.3; 108/55.1

[58] Field of Search ..... 108/51.1, 53.1, 108/53.3, 53.5, 55.1

[56] References Cited

U.S. PATENT DOCUMENTS

| | | | |
|---|---|---|---|
| 2,507,588 | 5/1950 | Brandon et al. . | |
| 3,138,398 | 6/1964 | Silverman | 108/55.1 X |
| 3,444,829 | 5/1969 | Mork | 108/53.3 |
| 3,507,415 | 4/1970 | Mankey | 108/53.3 X |
| 4,002,126 | 1/1977 | Bell et al. | 108/53.5 |
| 4,703,702 | 11/1987 | Speicher | 108/53.1 X |
| 4,890,560 | 1/1990 | Good . | |
| 5,018,629 | 5/1991 | Lamar | 108/53.1 X |
| 5,348,149 | 9/1994 | McCarthy | 108/53 X |

FOREIGN PATENT DOCUMENTS

| | | | |
|---|---|---|---|
| 3126092 | 1/1983 | Germany | 108/53.1 |
| 1191364 | 11/1985 | U.S.S.R. | 108/53.1 |

*Primary Examiner*—Jose V. Chen
*Attorney, Agent, or Firm*—Ira S. Dorman

[57] ABSTRACT

Angled leg structures on the skid permit nesting and optimize force accommodation, and an intermedial runner component is disposed for constraining engagement with an underlying skid, to enhance stack stability. A cradle-like skid may be employed to support cylindrical loads, and a skid having a flat, rectangular upper surface may be employed for supporting cubic loads; the cradle form of skid can be assembled with a rectangular table component to provide a flat supporting surface thereon.

14 Claims, 16 Drawing Sheets

STACKABLE SKID CONSTRUCTION

BACKGROUND OF THE INVENTION

Skids and pallets are of course in common use for transporting a wide variety of products. A circular pallet, intended to support a stack of spirally wound rolls of steel strapping, is shown in U.S. Pat. No. 2,507,588, to Brandon et al. Good U.S. Pat. No. 4,732,528 describes a square skid that is similarly intended for transporting products of coiled form, and a stackable, circular skid is taught by Good in U.S. Pat. No. 4,890,560.

SUMMARY OF THE DISCLOSURE

Despite the foregoing, a demand remains for a skid that is adapted to nest with other similar skids, without need for locating pins, holes, or the like, so as to provide a compact and stable stack; accordingly, it is a primary object of the present invention to provide a novel skid having such capability.

Another object of the invention is to provide such a skid of cradle-like form, for the support and transport of coiled loads, which skid has a high load-bearing capacity in relation to its size and weight.

A further object of the invention is to provide a skid comprised of a top panel component having a flat supporting surface, assembled with a cradle form of skid which functions as a base for the assembly.

It has now been found that certain of the foregoing and related objects of the invention are attained by the provision of a skid comprised of a pair of generally planar leg structures that extend endwise along its opposite sides, and are disposed substantially in upwardly convergent planes. Each leg structure includes an elongate rectilinear runner extending along a lower portion thereof and lying substantially in a common bottom plane, and an elongate rectilinear support piece extending along an upper portion thereof and lying substantially in a common top plane which is parallel to the bottom plane. A pair of crosspieces extend along the opposite ends of the skid, and join the leg structures to one another. At least one intermedial runner component is operatively joined to the crosspieces, and has a central part that is disposed between the leg structures and substantially in the bottom plane; the central part is of such length as to fit between the crosspieces of a like, underlying skid, and it provides abutment elements proximate the crosspieces for constraining engagement therewith.

In certain embodiments the crosspieces of the skid will lie substantially in a plane that is intermediate and parallel to the top and bottom planes, and the support pieces will have flat upper surfaces that lie in planes perpendicular to the planes of the leg structures that they comprise. The central part of the intermedial runner component will normally be an elongate rectilinear piece having opposite end surfaces that constitute the abutment elements, with supporting legs serving to join the central part to the crosspieces. At least bottom portions of the runners and of the central part of the intermedial runner component will desirably be of convex arcuate cross section, to best adapt them for conveyor transport; generally, those elements will be of cylindrical form.

In other embodiments the skid will further include an upper panel portion comprised of a plurality of members defining a planar top support surface, the panel portion having an opening dimensioned and configured to permit passage therethrough of the intermedial runner component of an overlying skid. The crosspieces of such a skid will normally lie substantially in the top plane thereof, and the upper panel portion will normally be of generally rectangular configuration, taken in plan view.

Additional objects of the invention are attained by the provision of a skid having the features described, assembled (as a base) with a separate, upper panel component comprised of a plurality of members defining a planar top support surface. The panel component is disengageably supported on the support pieces of the leg structures of the base, and it has openings that are dimensioned and configured to permit passage of the leg structures and the intermedial runner component of an overlying skid, for stacking purposes; it will normally include elements that are disposed thereon to engage the upper surfaces of the underlying support pieces.

DETAILED DESCRIPTION OF THE ILLUSTRATED EMBODIMENTS

Figure 1:
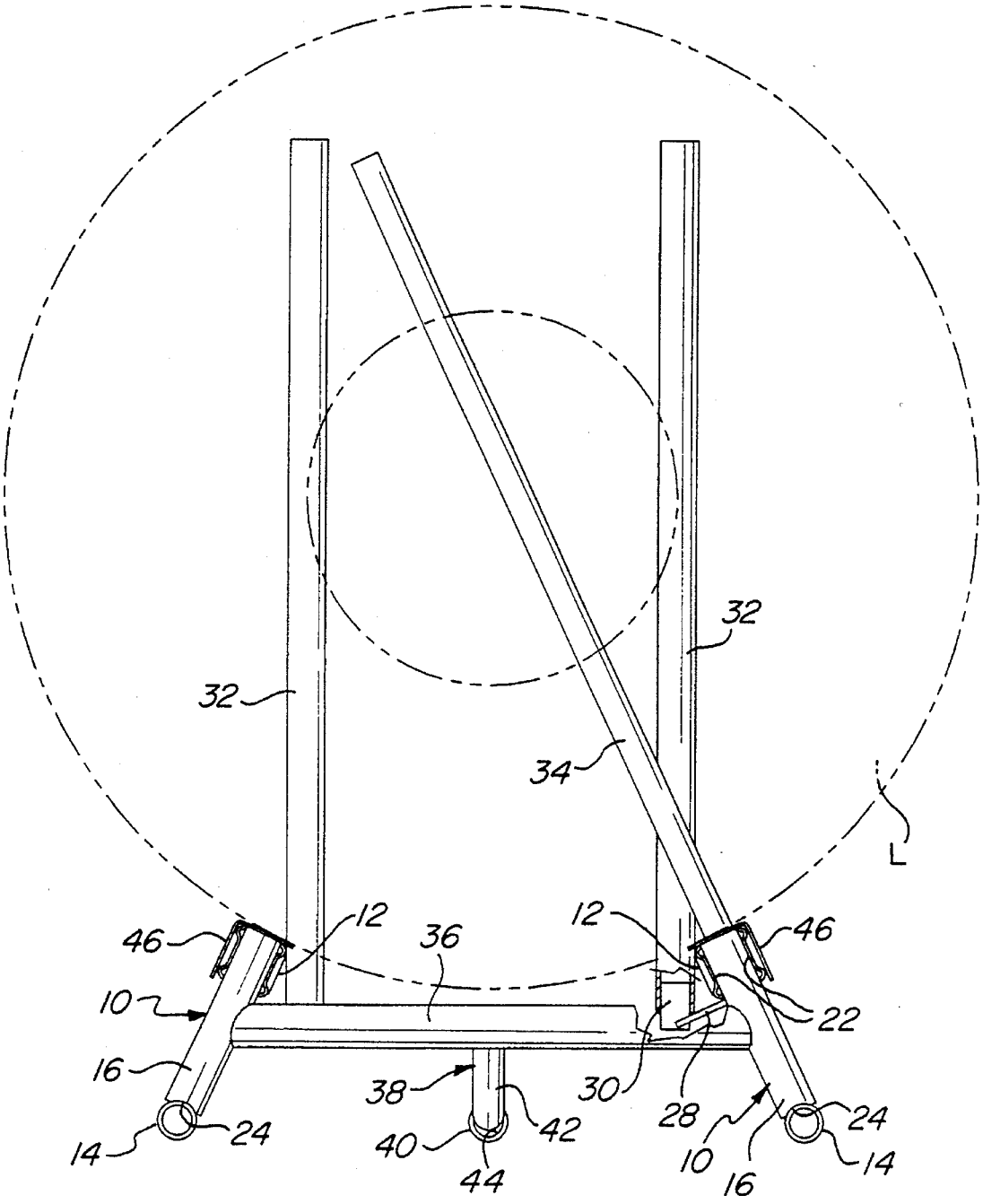
FIG. 1 is an end elevational view of a first embodiment of the skid of the present invention, supporting a coil-form load depicted in phantom line.

Turning initially to FIGS. 1 through 6 of the drawings, therein illustrated is a cradle-like skid embodying the present invention and adapted to support a load "L" consisting two side-by-side coils of a material such as wire or metal strip. The skid is of welded-metal construction (as are the other skids hereinafter described), and it consists essentially of a pair of generally planar leg structures extending endwise (transversely) along opposite sides of the skid, joined to one another by a pair of crosspieces 36 extending from side-to-side (laterally) along the opposite ends of the skid. Each leg structure includes a length of square tubing providing an upper support piece 12, a length of circular tubing providing a bottom runner 14, and two outer legs 16 and a central leg 18 fabricated from circular tubing and extending between the elements 12 and 14. A semi-circular indentation 20 is cut into the opposite end portions of the upper support piece 12, which portions are crimped at 22 to more closely conform to the attached sections of the legs 16; the lower ends of the legs 16 are also formed with semicircular indentations at 24, to conform to the contour of the runner 14. It should be noted that the indentations 24 are sufficiently shallow to leave narrow gaps 26 between the runner 14 and the ends of the legs 16, which serve the desirable function of permitting drainage of water that might otherwise accumulate within the legs.

A mounting plate 28, having semi-circular indentations formed in its opposite ends (only indentation 29 being visible in FIG. 3), is affixed to the leg structure 10 in a central location against the underside the support piece 12. A short, cylindrical stub element 30 is attached to the free end of the plate 28, and is dimensioned to telescopically seat and engage within the bottom end of a separator post 32. The plate 28 is of sufficiently thin cross section to enable bending, for varying the attitude of the post 32 if so desired. It might also be noted that the stub element 30 is disposed below the level of the support pieces 12, and hence below the top plane of the skid; this facilitates support of a load that crosses the center-line of the skid, e.g., a single, wide coil.

An intermedial runner component, generally designated by the numeral 38, is attached midway between the opposite ends of the crosspieces 36 and includes a transversely extending center tubular runner 40, of circular cross section, and a pair of angled legs 42 by which the runner 40 is attached; indentations 43 are formed in the opposite ends 44 of the runner 40 to accommodate the legs 42.

Figure 7:
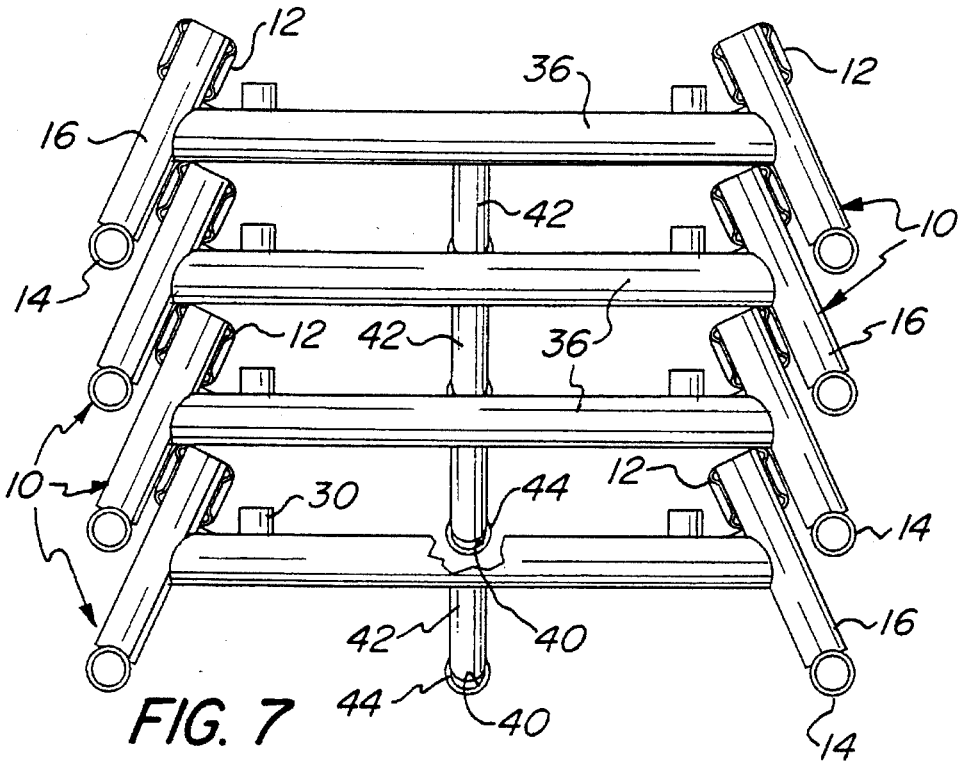
FIGS. 7 and 8 are end and side elevational views, respectively, showing a stack of four of the skids of the preceding Figures.
Figure 8:
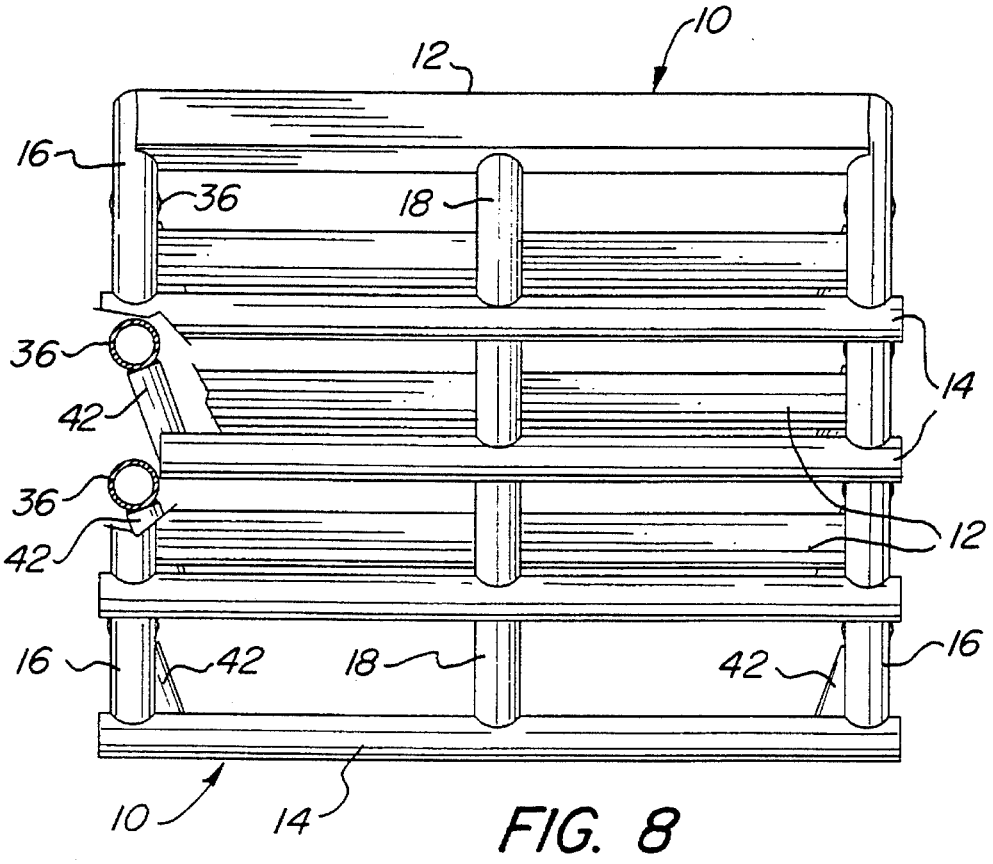
Figure 9:
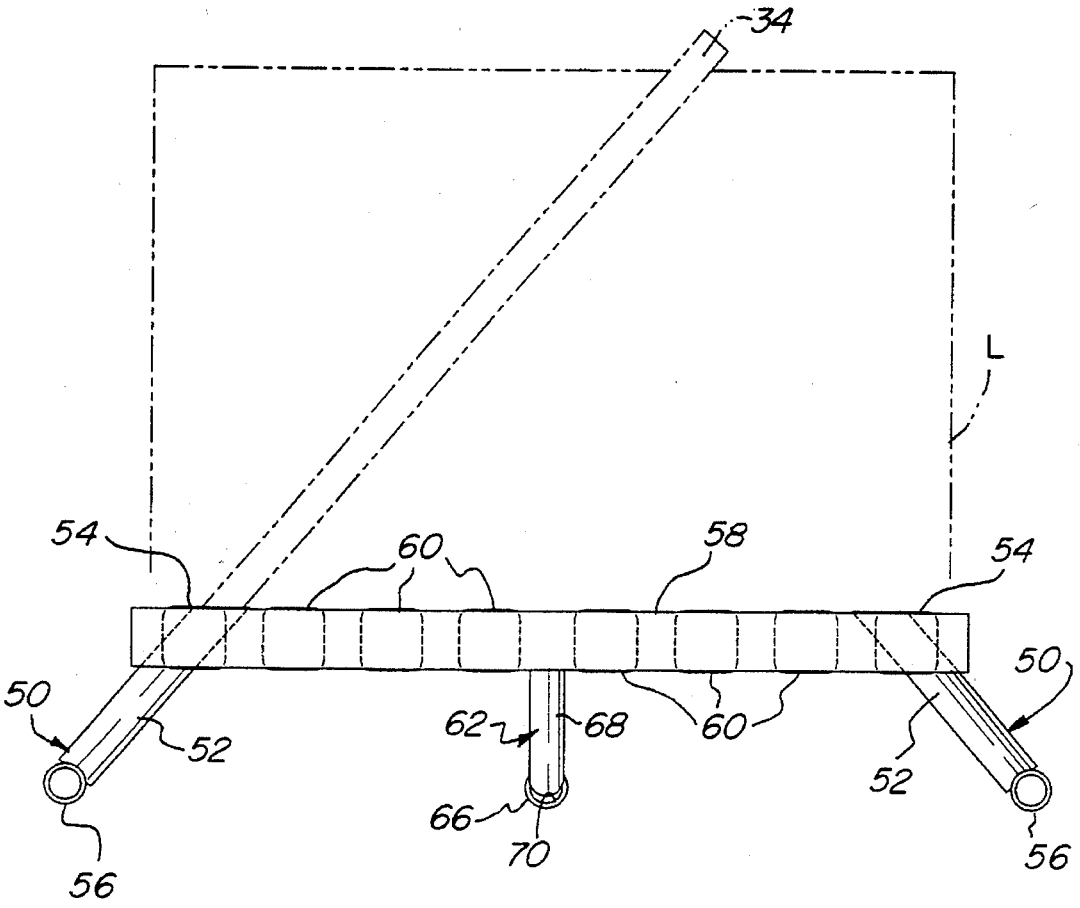
FIG. 9 is an end elevational view of a second form of skid embodying the present invention, showing in phantom line a cubic load supported thereby.
Figure 10:
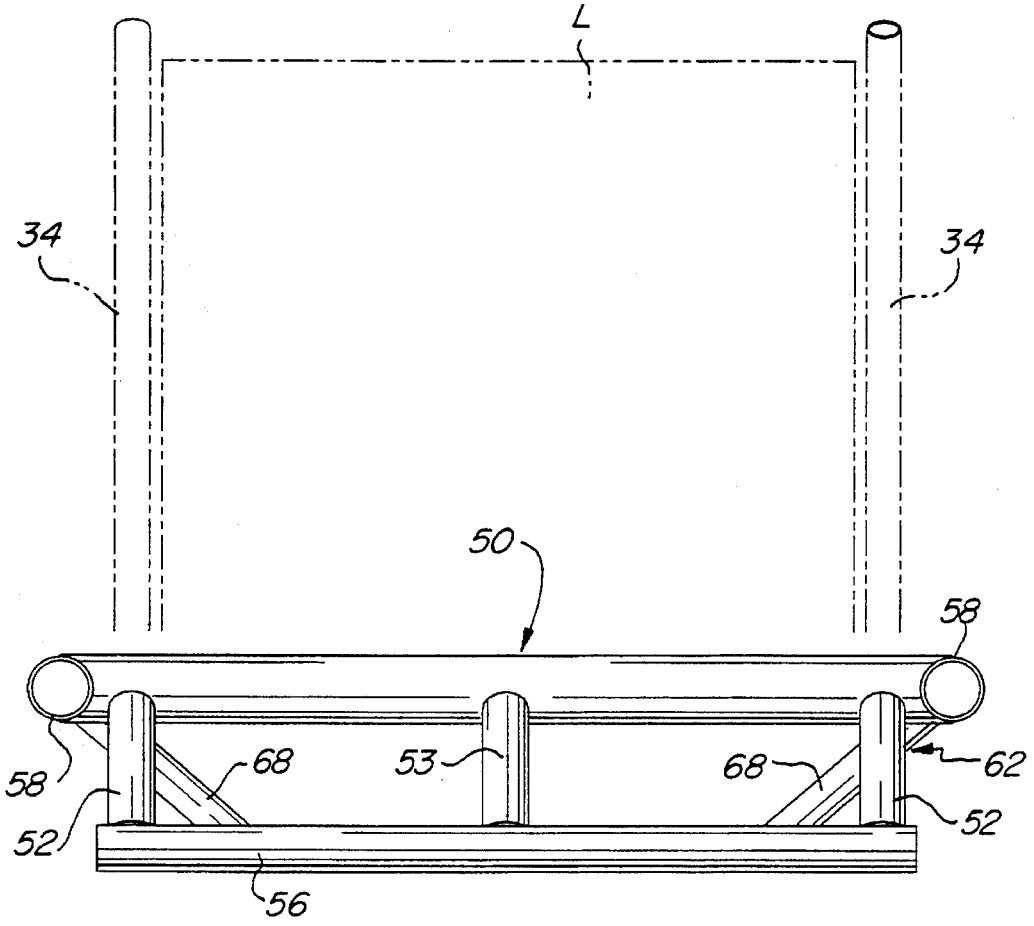
FIG. 10 is a side elevational view illustrating the skid of FIG. 9.
Figure 11:
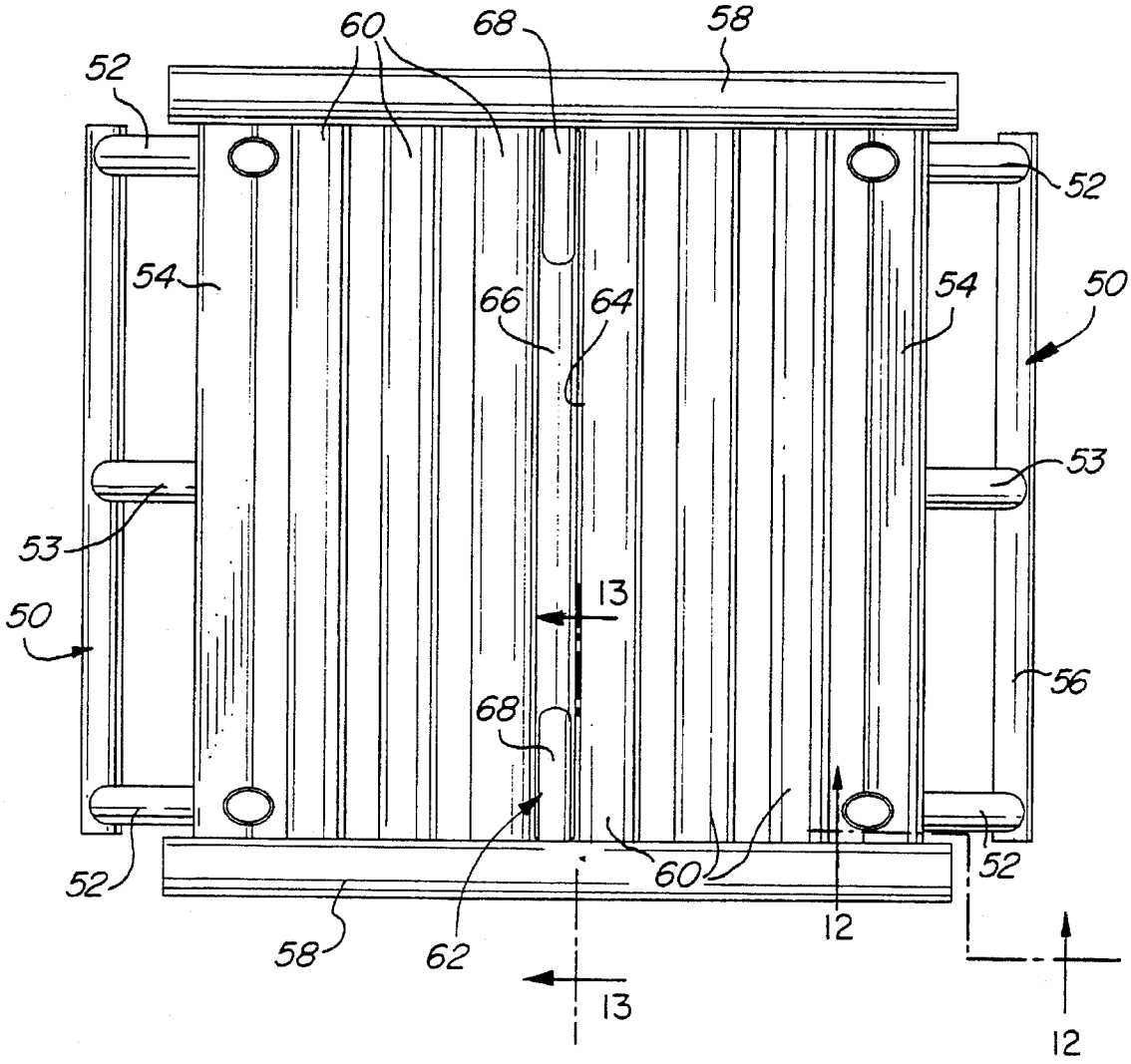
FIG. 11 a plan view of the skid of FIGS. 9 and 10.
Figure 12:
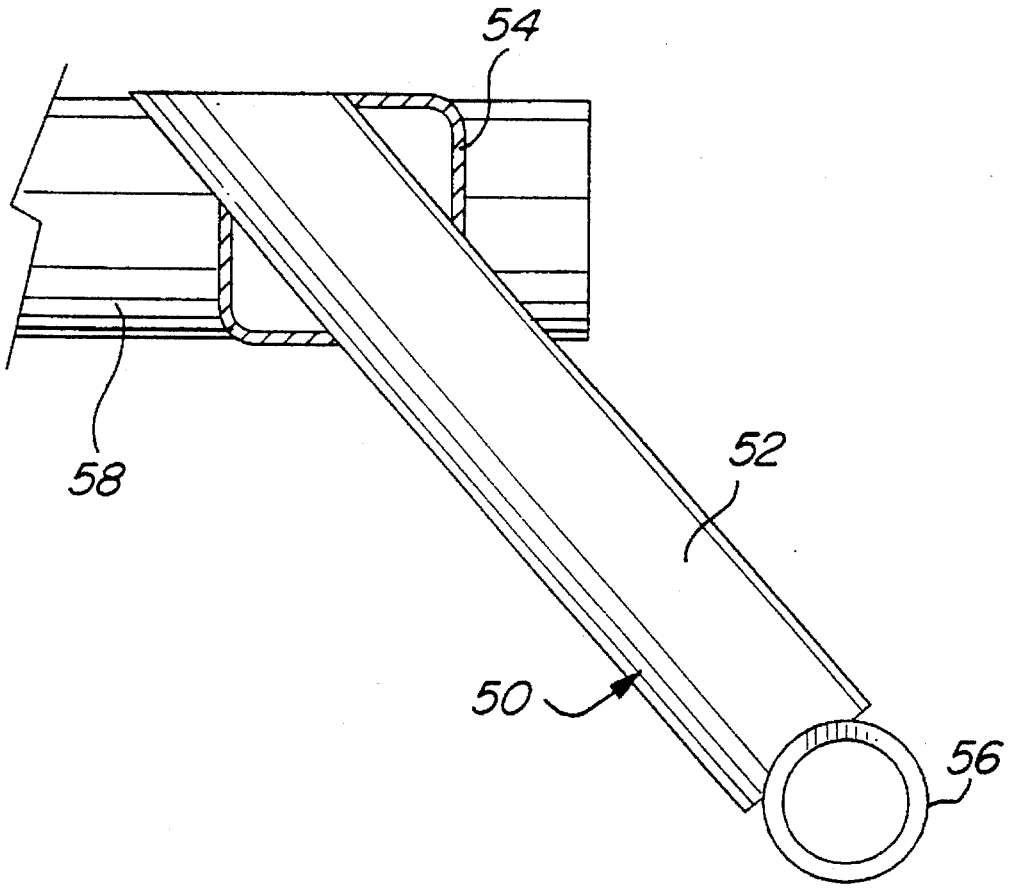
FIG. 12 is a sectional view taken along line 12—12 of FIG. 11, drawn to a scale enlarged therefrom.
Figure 13:
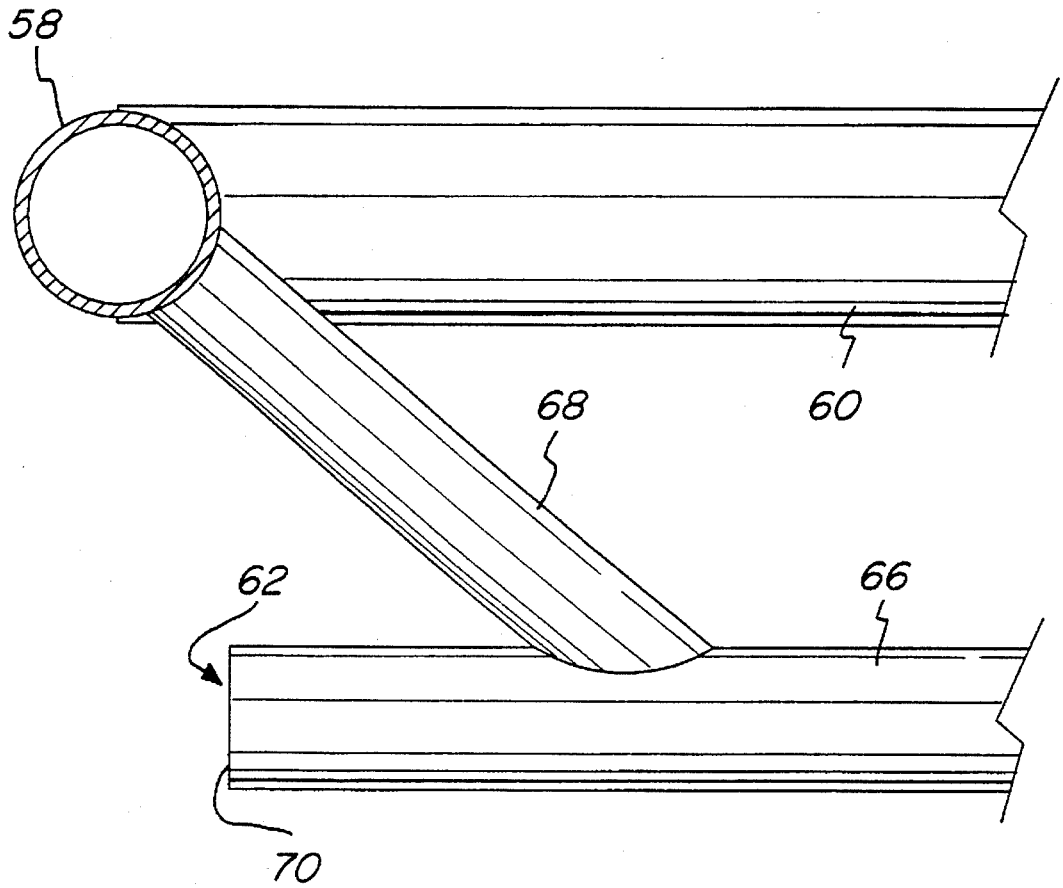
FIG. 13 is a sectional view taken along line 13—13 of FIG. 11.

FIGS. 7 and 8 show stacking of a plurality of the skids illustrated in the preceding Figures. As can be seen, they are nested, one atop another, with the leg structures 10 of the upper skids conforming to and resting upon the leg structures of the underlying skids (with the respective support pieces 12 and crosspieces 36 in most direct contact), thus affording lateral stability to the stack. In addition, the end surfaces 44 of the center runners 40 of each skid lie proximate the crosspieces 36 of the underlying skid (see particularly FIG. 8), thereby presenting a potential constraint and affording transverse stability to the stack as well.

Figure 2:
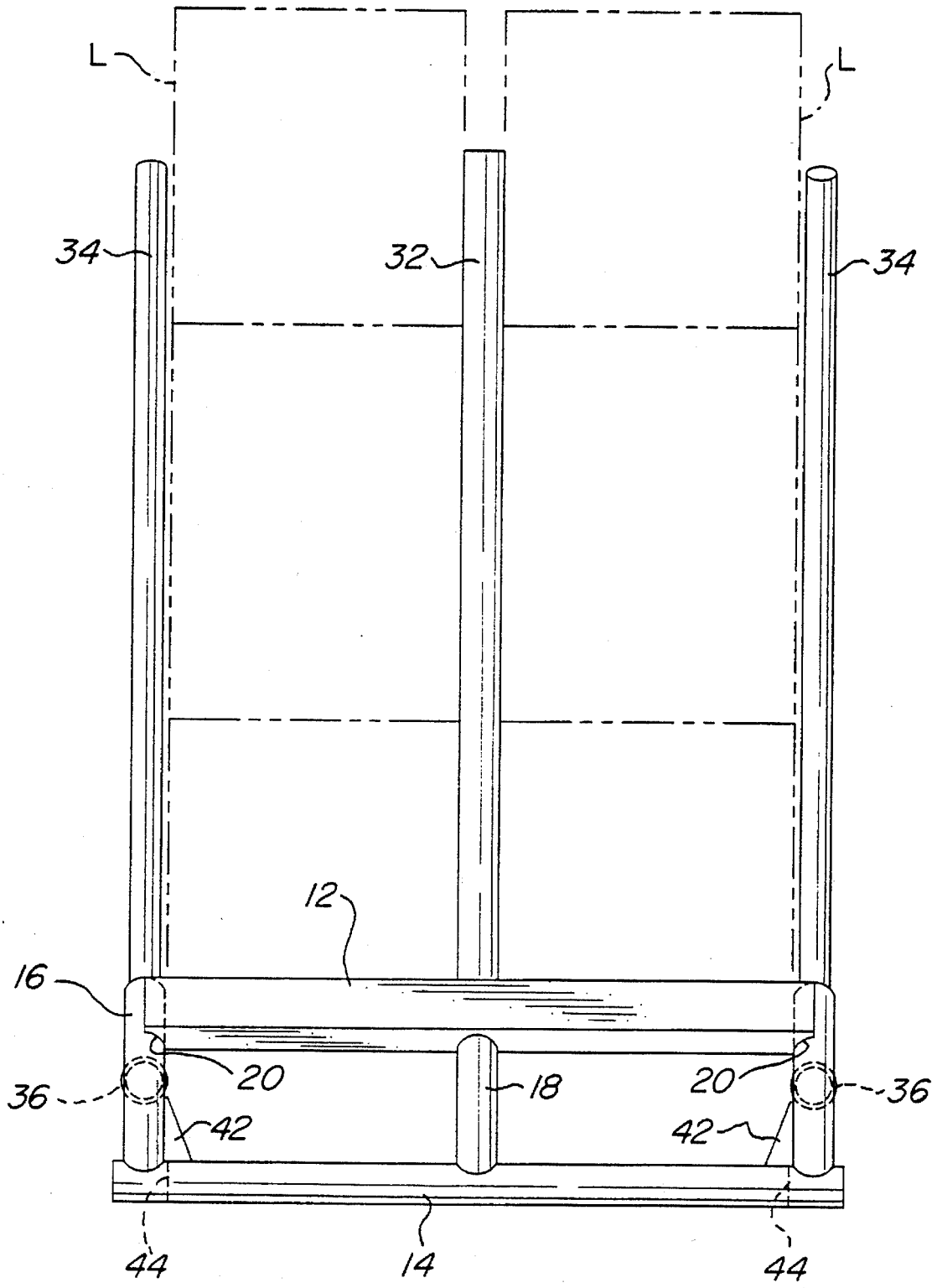
FIG. 2 is a side elevational view illustrating the skid of FIG. 1.
Figure 3:
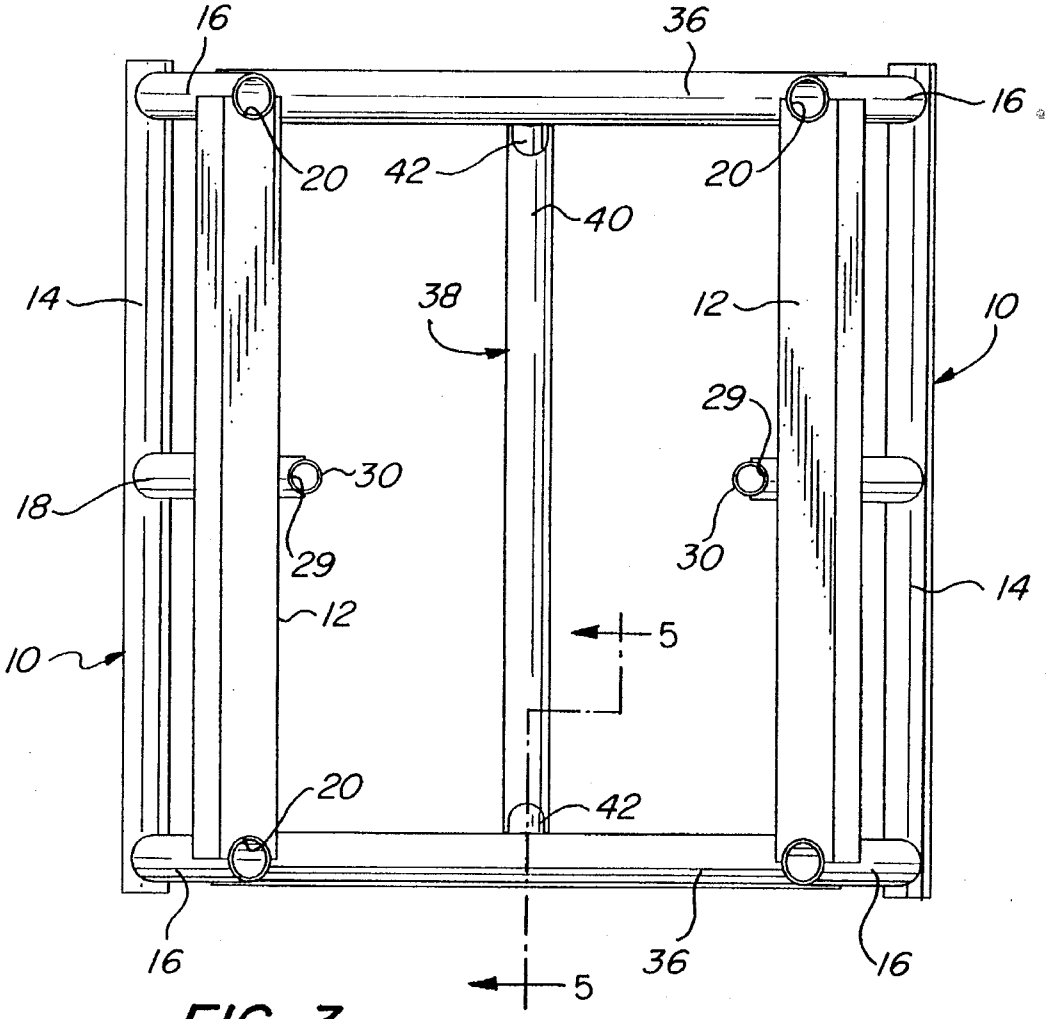
FIG. 3 is a plan view of the skid.
Figure 4:
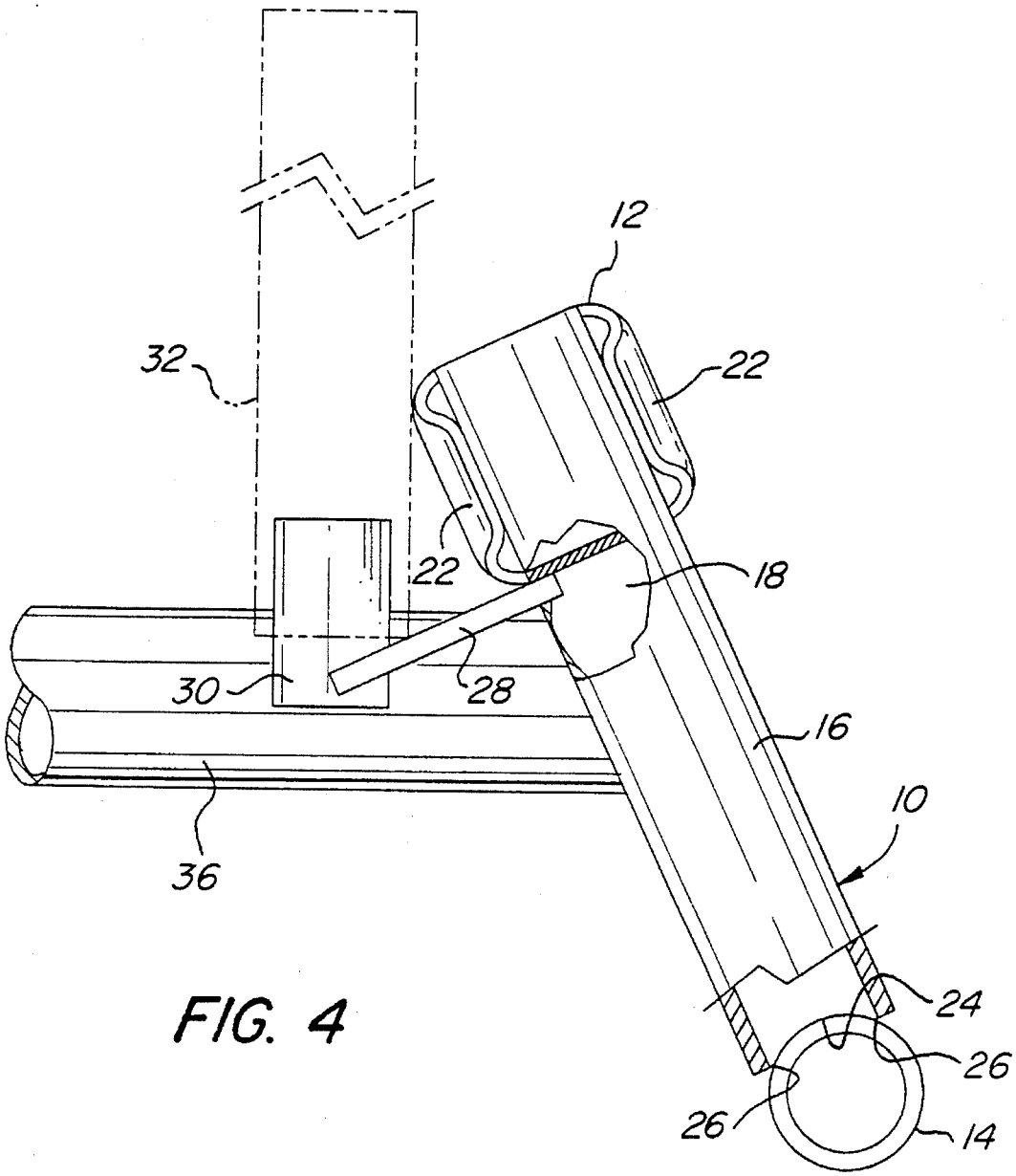
FIG. 4 is a fragmentary view illustrating a portion of the skid along one side, drawn to an enlarged scale and taken at transverse sections.
Figure 5:
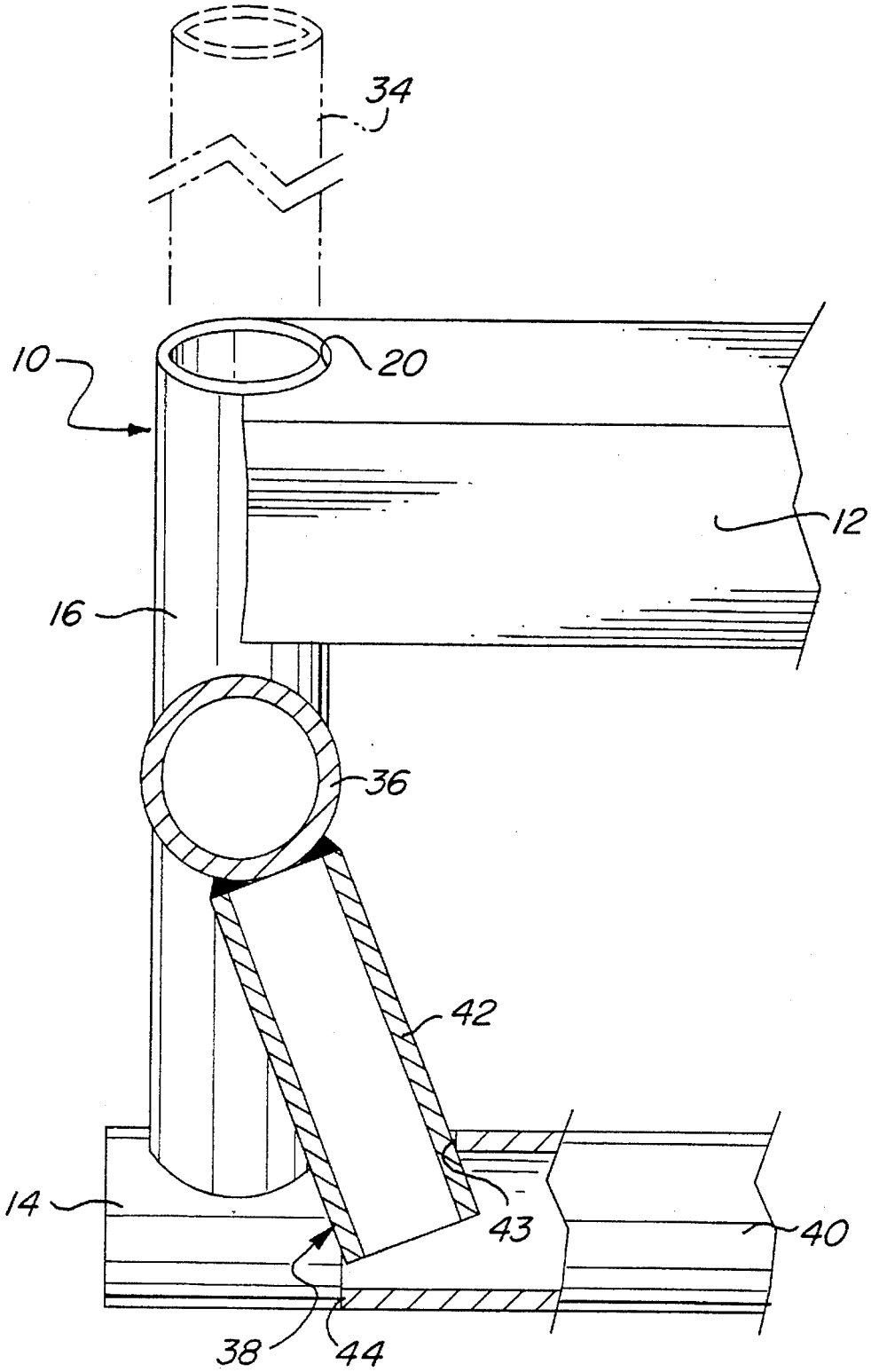
FIG. 5 is a fragmentary, sectional view of the skid taken along line 5—5 of FIG. 3, drawn to an enlarged scale and having portions broken away to expose otherwise hidden features.
Figure 6:
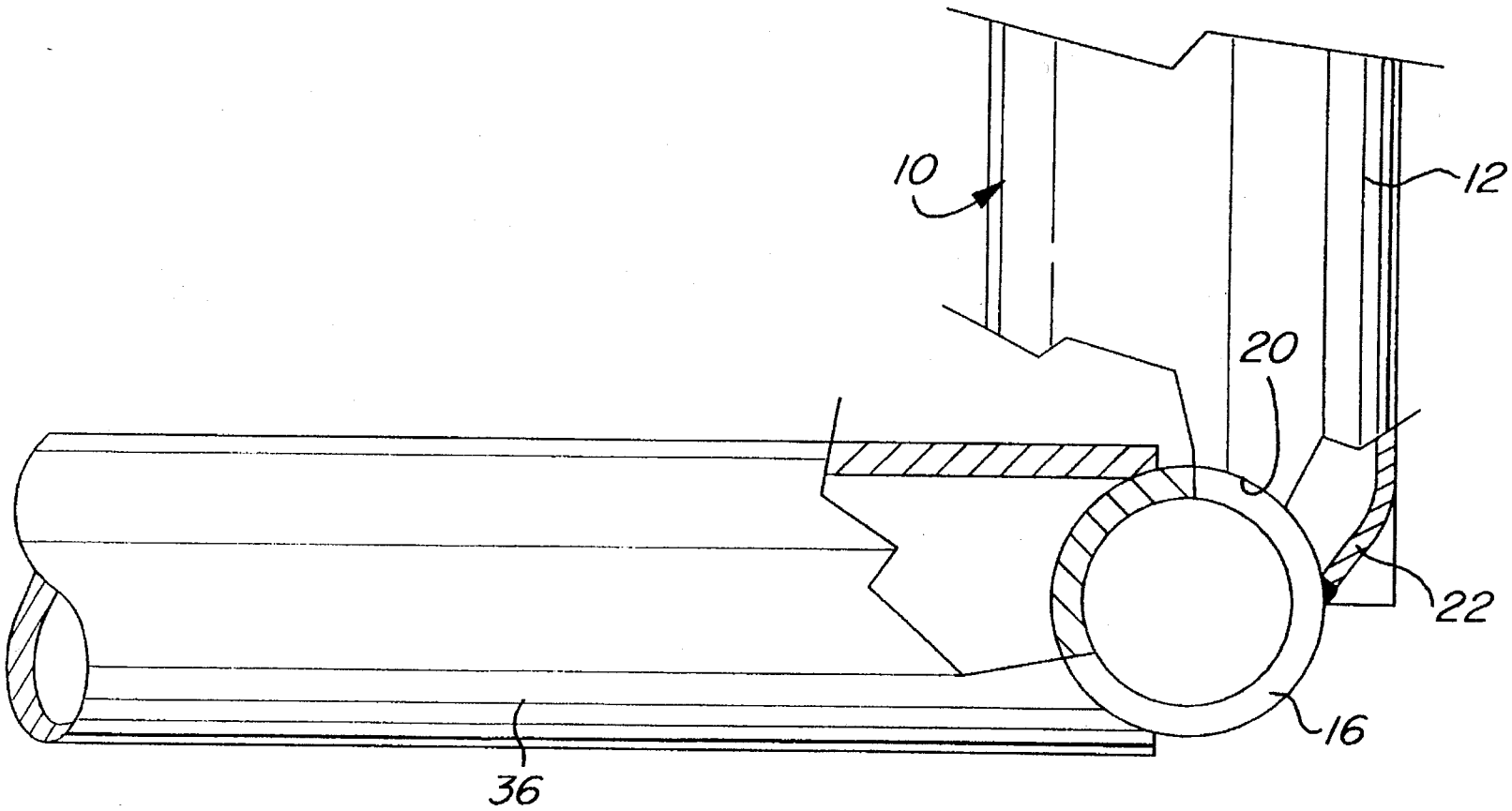
FIG. 6 is a fragmentary plan view of a corner of the skid, drawn to an enlarged scale and taken in a plane to which the axis of the depicted leg is normal, portions being broken away to expose otherwise hidden features.

Stabilizer posts 34 are inserted into the open ends of the legs 16 to extend along the outer sides of the coils of load "L"; the cavities may also serve as receptacles for in-process manufacturing or transport documentation, for holding product samples, etc. As previously noted, the stub elements 30 serve to support the separator posts 32 between the two adjacent coils (as best seen in FIG. 2). It will also be noted that protection for the coil outer wrap and the skid can be provided by interpositioning angleboard (cardboard angle) therebetween, which will remain in the relationship shown in FIG. 1 due to the orientation of the support pieces 12.

In addition to the stacking capability afforded thereby, the upwardly convergent angular disposition of the leg structures will contribute significantly to the load-bearing capacity of the skid. As will be appreciated (and is graphically suggested by reference to the stabilizer post 34 in FIG. 1), the lines of force exerted by the coil will act substantially parallel to the planes of the leg structures, to thereby reduce moment loads; this factor, as well as other design features incorporated into the skid, will enable its fabrication from components that are of lighter weight than would otherwise be the case.

FIGS. 9 through 15 of the drawings illustrate a second form of stackable skids embodying the invention, constructed to have a planar, rectangular top portion for the support of cubic loads. The skid includes a pair of leg structures, generally designated by the numeral 50, extending endwise along the opposite sides, each structure 50 consisting of a square tubular support piece 54 at the top, a circular tubular runner 56 extending along the bottom, and two end legs 52 and an intermedial leg 53 all of circular tubular construction joining the support piece 54 and the runner 56 to one another. It will be noted that here again the leg structures 50 lie generally in planes that converge in an upward direction; in this form of skid, however, the upper surfaces of the support pieces 54 lie fully within the top common plane of the skid. A pair of crosspieces 58 of circular cross section extend laterally along the opposite ends of the skid, and are spanned by the support pieces 54 as well as by six additional lengths of square tubular members 60, 60' which also have flat upper surfaces lying in the top plane of the skid.

Figure 14:
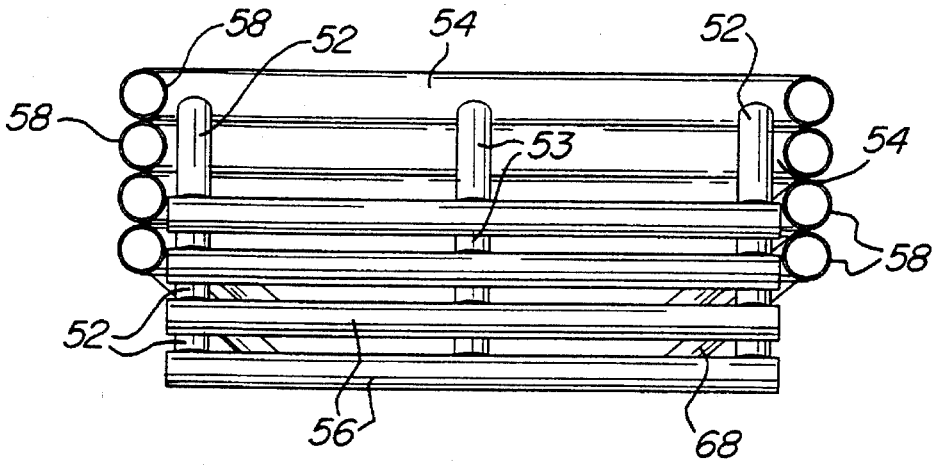
FIGS. 14 and 15 are end and side elevational views, respectively, of a stack of four of the skids illustrated in FIGS. 9 through 13.
Figure 15:
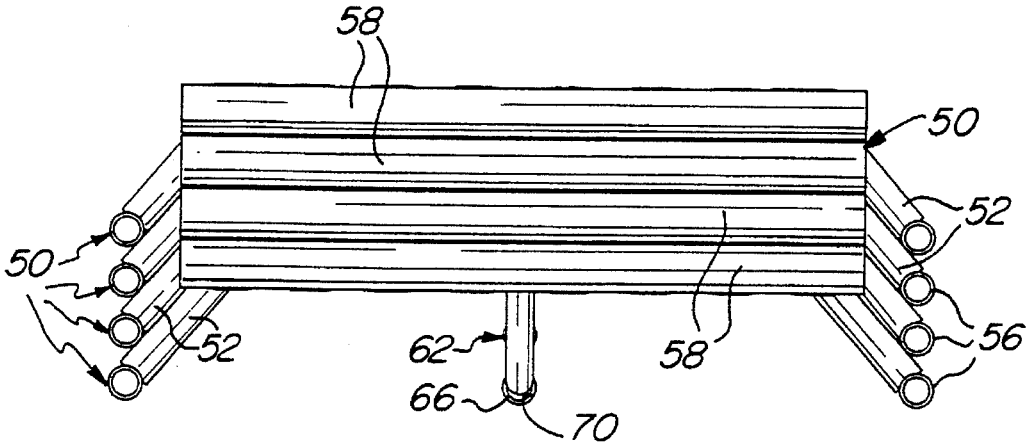

An intermedial runner component, generally designated by the numeral 62, consists of a runner 66 attached at its opposite ends to a pair of angled legs 68, which are in turn attached to the crosspieces 58. The centermost members 60' are spaced from one another to provide a gap 64 of sufficient width to permit passage therebetween of the intermedial runner component 62. When the skids are stacked, therefore (as illustrated in FIGS. 14 and 15), the intermedial runner component 62 of one skid will project through the gap 64 of the skid lying beneath it, disposing the end surfaces 70 of the runner 66 adjacent the crosspieces 58 and thereby contributing to the stability of the stack, as previously described.

Figure 16:
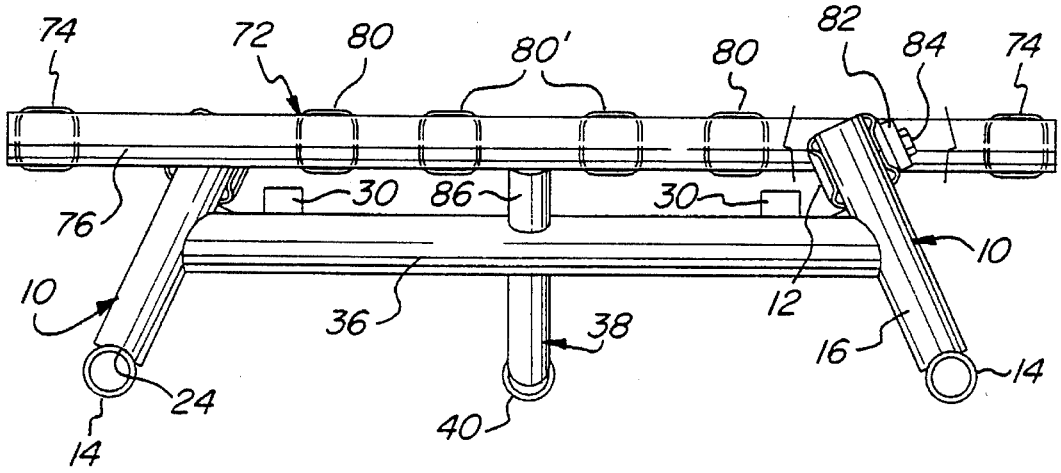
FIG. 16 is an end elevational view of a skid assembly embodying the present invention, with a portion broken away to show otherwise hidden features.
Figure 17:
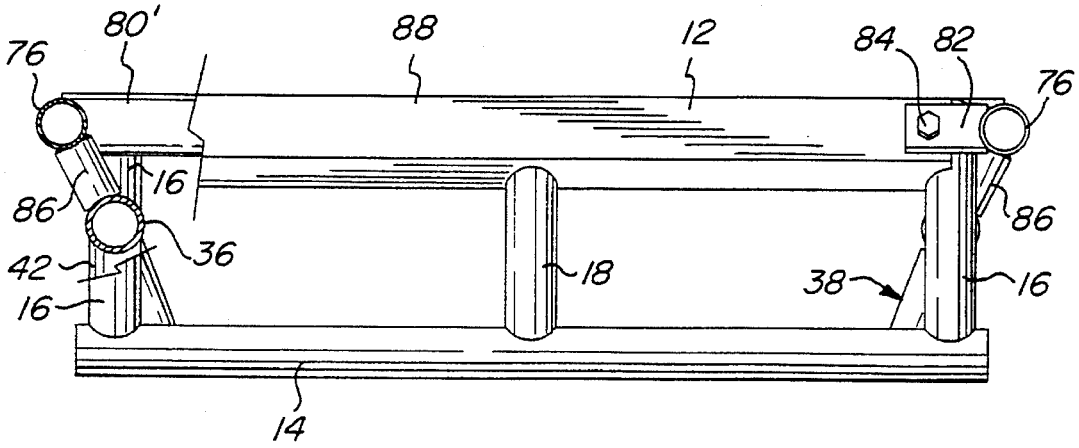
FIG. 17 is a side elevational view illustrating the assembly of FIG. 16, taken in partial section substantially along line 17—17 of FIG. 18.
Figure 18:
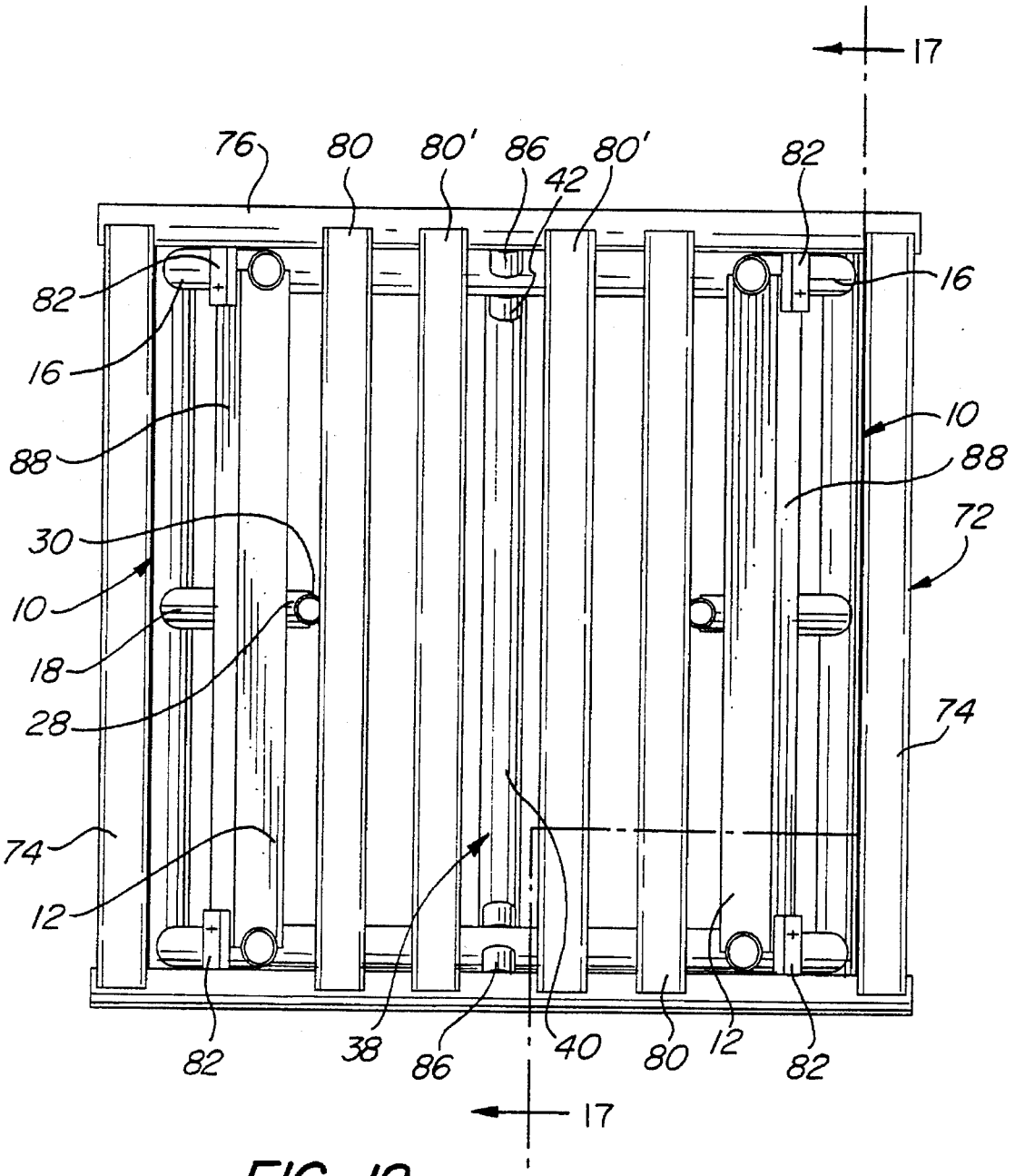
FIG. 18 is a plan view of the assembly of the preceding two Figures.

Turning finally to FIGS. 16 through 18 of the drawings, the skid depicted therein comprises an assembly of the cradle-like skid of FIGS. 1 through 8, utilized as a base to support a top panel or table component, the latter being generally designated by the numeral 72. Common numbers are utilized to represent the elements of the cradle-like skid (i.e., the base) in these and the preceding Figures, and further description thereof need not therefore be provided.

The table component 72 consists of a pair of square tubular support pieces 74, interconnected at their opposite ends by tubular crosspieces 76 of circular cross section, and four square tubular members 80, 80' extending endwise between the crosspieces 76. The end-most members 80 are spaced from the adjacent support pieces 74 a distance sufficient to permit passage therebetween of the leg structures 50; similarly, the center-most members 80' are spaced from one another a distance sufficient to permit passage therebetween of the intermedial runner component 38.

The table component 72 includes four engagement lugs 82, which project inwardly from the crosspieces 76 and are oriented to match the angles of the outer wall elements 88 of the support pieces 12, for stable engagement thereupon. In addition, short cylindrical struts 86 are attached to the crosspieces 76 at central locations, and rest upon the underlying crosspieces 36 for added support. Accordingly, the table component 72 is adapted to securely seat upon the underlying base skid, and will normally be fastened thereto by bolts 84 inserted through the lugs 82, to prevent inadvertent disassembly.

Although not illustrated, it will be appreciated that the skid assembly of FIGS. 16 through 18 can be stacked with one another (and indeed with the separate skid bases), by virtue of the spacing of the members 80, 80' as described. The leg structures 10 and runner component 38 of one skid will pass between the members 74, 80, 80' of the underlying skid, to lie in the relative positions hereinabove described.

Thus, it can be seen that the present invention provides a novel skid that is capable of nesting with other, like skids, without need for locating pins, holes, or the like, so as to provide a compact and stable stack. The skid may be of cradle-like form, for the support and transport of coiled loads, and it may be assembled with a table component to provide a flat supporting surface; an integral "square top" style of skid is also provided. The angled orientation of the leg structure serves not only to optimize load-bearing capacity but also to limit the lateral approach of adjacent skids, and thereby to prevent the goods on one skid from colliding with goods carried on another. The prevalence of rounded exposed surfaces helps to reduce the likelihood of damage occurring during movement of the skids, and yet additional design advantages have been pointed out hereinabove,

Having thus described the invention, what is claimed is:

1. A skid adapted for stacking with other like skids and being of generally rectangular configuration, taken in plan view, and having a top, a bottom, two opposite sides and two opposite ends, said skid comprising a pair of generally planar leg structures extending endwise along said opposite sides and disposed substantially in planes that converge in an upward direction, each of said leg structures including an elongate rectilinear runner extending endwise along a lower portion thereof and lying substantially in a common bottom plane, and an elongate rectilinear support piece extending endwise along an upper portion thereof and lying substantially in a common top plane parallel to said bottom plane; a pair of crosspieces extending crosswise along said opposite ends of said skid and joining said leg structures to one another; and at least one intermedial runner component operatively joined to said crosspieces and having a central part disposed between said leg structures and substantially in said bottom plane, said central part having a length less than the distance between said crosspieces so as to fit between the crosspieces of a like, underlying skid, and having abutment elements thereon, said crosspieces and said abutment elements being so located as to dispose said abutment elements proximate the crosspieces of such an underlying skid when stacked thereupon; whereby said skid can be stacked upon another like skid with said leg structures nested upon the leg structures of the underlying skid and with said central part of said intermedial runner component disposed between said crosspieces thereof, said abutment elements on said central part serving to constrain said skid against endwise displacement by engagement with the crosspieces of the underlying skid.

2. The skid of claim 1 wherein said crosspieces lie substantially in a plane intermediate said top and bottom planes, and parallel thereto.

3. The skid of claim 1 wherein said support pieces have flat upper surfaces.

4. The skid of claim 3 wherein said upper surface of said support piece of each of said leg structures lies in a plane perpendicular to said plane of said leg structure.

5. The skid of claim 1 wherein said central part of said intermedial runner component is an elongate rectilinear piece having opposite end surfaces constituting said abutment elements, and wherein said runner component includes supporting legs joining said central part to said crosspieces.

6. The skid of claim 5 wherein at least bottom portions of said runners and of said central part of said intermedial runner component are of convex arcuate cross section along the lengths thereof.

7. The skid of claim 1 wherein each of said leg structures comprises a plurality of legs joining said runner to said support piece and disposed substantially in said plane thereof.

8. The skid of claim 7 wherein said legs, said runners, said central part of said runner component, and said crosspieces are all of cylindrical form.

9. The skid of claim 1 further including an upper panel portion comprised of a plurality of members defining a planar top support surface on said skid, said panel portion having an opening therethrough dimensioned and configured to permit passage of the intermedial runner component of an overlying like skid, for such engagement with said crosspieces of said skid.

10. The skid of claim 9 wherein said crosspieces lie substantially in said top plane.

11. The skid of claim 9 wherein said upper panel portion is of generally rectangular configuration taken in plan view.

12. A skid adapted for stacking with other like skids and being of generally rectangular configuration taken in plan view, and having a top, a bottom, two opposite sides and two opposite ends, said skid comprising a pair of generally planar leg structures extending endwise along said opposite sides and disposed substantially in planes that converge in an upward direction, each of said leg structures including an elongate rectilinear runner extending endwise along a lower portion thereof and lying substantially in a common bottom plane, and an elongate rectilinear support piece extending endwise along an upper portion thereof and lying substantially in a common top plane parallel to said bottom plane; a pair of crosspieces extending crosswise along said opposite ends of said skid and joining said leg structures to one another; and at least one intermedial runner component operatively joined to said crosspieces and having a central part disposed between said leg structures and substantially in said bottom plane, said central part having a length less than the distance between said crosspieces so as to fit between the crosspieces of a like, underlying skid, and having abutment elements thereon, said crosspieces and said abutment elements being so located as to dispose said abutment elements proximate the crosspieces of such an underlying skid when stacked thereupon; said skid additionally including a table component comprised of a plurality of members defining a planar top support surface, said table component having openings therethrough dimensioned and configured to permit passage of the leg structures and the intermedial runner component of an overlying like skid, and said table component being disengageably supported on said support pieces of said leg structures; whereby said skid can be stacked upon another like skid with said leg structures nested upon the leg structures of an underlying skid and with said intermedial runner part disposed between said crosspieces thereof, said abutment elements on said runner part serving to constrain said skid against endwise displacement by engagement with the crosspieces of the underlying skid.

13. The skid of claim 12 wherein said crosspieces lie substantially in a plane intermediate said top and bottom planes, and parallel thereto.

14. The skid of claim 12 wherein said support pieces have flat upper surfaces, said upper surface of said support piece of each of said leg structures lying in a plane perpendicular to said plane of said leg structure, and wherein said table component has elements thereon disposed to engage said upper surfaces of said support pieces for supporting said table component thereon.

* * * * *